United States Patent [19]

Hughes

[11] 3,954,093

[45] May 4, 1976

[54] IGNITION DEVICE FOR ENGINES

[76] Inventor: James C. Hughes, 172 Poinsetta Circle, Terrell, Tex. 75160

[22] Filed: May 21, 1973

[21] Appl. No.: 362,108

[52] U.S. Cl. ..... 123/143 A; 123/143 R; 123/145 R; 123/32 AH; 123/32 E; 123/32 J

[51] Int. Cl.[2] ..... F02P 23/00

[58] Field of Search ..... 123/145 R, 143 R, 32 J, 123/32 C, 32 AA, 32 AH, 32 E, 143 A

[56] References Cited

UNITED STATES PATENTS

| | | | |
|---|---|---|---|
| 563,051 | 6/1896 | Nash | 123/32.5 |
| 1,501,505 | 7/1924 | Walters | 123/143 R |
| 2,065,025 | 12/1936 | Ricardo | 123/32 AA |
| 2,120,768 | 6/1938 | Ricardo | 123/32 AA |
| 2,719,514 | 10/1955 | Schilling | 123/32 AA |
| 2,996,056 | 8/1961 | Vierling | 123/145 R |
| 3,481,317 | 12/1969 | Hughes et al. | 123/143 R |

*Primary Examiner*—Charles J. Myhre
*Assistant Examiner*—James D. Liles
*Attorney, Agent, or Firm*—Thomas L. Cantrell; Joseph H. Schley

[57] ABSTRACT

Disclosed are cell-type ignition devices for Otto cycle internal combustion engines, said devices having cylindrical cells with end orifices communicating with the engine combustion chamber. The devices include housing and mounting means for thermally isolating the cell from the cooled engine wall and the ambient atmosphere. Critical ratios for cell dimensions are disclosed. Some embodiments are equipped with supplementary glow or spark ignition means for starting and warm-up. In some embodiments, sleeves or external protubances on the cell wall are employed to regulate ignition timing by controlling heat transfer.

9 Claims, 12 Drawing Figures

IGNITION DEVICE FOR ENGINES

BACKGROUND OF THE INVENTION

This invention relates to ignition devices for engines of the kind in which a fuel-air mixture is introduced into a combustion chamber where it is compressed, ignited, expanded and exhausted in a repetitive cycle. It is applicable to Otto cycle engines, including two and four cycle piston engines, free piston engines, and rotary engines, such as Wankel engines. The invention is particularly concerned with ignition cell devices of the kind which are capable of performing the ignition function in a running engine without the use of an externally-supplied, timed electrical spark, which has been the type of ignition system most widely used heretofore.

Despite their nearly universal employment, electrical ignition systems for internal combustion engines have well-recognized disadvantages, One of these is the cost of the ignition equipment itself. Another is the necessity for maintenance of the parts of the electrical system. Such a system normally includes a number of small moving parts that wear more rapidly than the more massive moving parts of the engine itself, and electrical components which deteriorate through exposure to heat, moisture, engine oil and oil residue.

Electrical spark ignition systems broadcast in commonly used radio frequencies, and special steps must be taken to shield them or otherwise prevent this radio interference.

Another disadvantage is that the added parts involved in an electrical ignition system decrease the reliability and longevity of the engine operation. For critical applications, such as in aircraft engines, it has become mandatory to use a dual electrical system with complete duplication of parts and equipment, in order to gain some assurance of reliability.

One common source of electrical ignition system unreliability is the fouling of spark plugs caused by lubricating oil being forced past seals (e.g. piston rings) into the combustion chamber and incompletely burning there to leave a deposit on the spark plug electrodes. Organometallic deposits derived from fuel additives are another source of spark plug fouling.

The problem of electrical ignition system reliability is much more severe in an engine equipped with a catalytic exhaust gas converter, as is presently contemplated for general adoption to reduce air pollution, than it is in an engine not so equipped. Failure of a single spark plug in a multi-cylinder engine will ordinarily not cause an engine stoppage, but it will result in the pumping of a large quantity of unburned fuel (mixed with air) through the cylinder having the failed plug into the catalyst chamber. There the mixture will burn, and this burning of a larger-than-planned-for quantity of fuel in a converter designed to handle relatively minute amounts of unburned fuel per unit time will quickly cause the catalyst to overheat, break down, form a powder, and blow out the exhaust pipe. In less than five minutes an entire expensive catalyst charge can be destroyed in this manner.

Other disadvantages are inherent in electrical ignition systems. The timing of such systems, even when performed through solid state electronic circuits, is essentially mechanical, that is, the time of initiation of a spark at a spark plug is determined by the position of the mechanical parts of the engine and the combustion chamber conditions which ought to exist with the mechanical parts in that position, rather than being determined by the precombustion conditions actually existing in the engine. Wear or maladjustment in the mechanical timing system causes mistiming of the spark. In addition, experience has shown that spark timing should be varied with engine speed, and this, too, is accomplished mechanically, with a similar liability to mistiming through wear or maladjustment.

Another disadvantage is that a spark plug, no matter how it is designed, results in initiation of the burning of the fuel in the combustion chamber at a very localized point, a fact having numerous undesirable implications, including incomplete combustion, the need for intense care in the design of the combustion chamber space, and cooling problems. One undesirable effect attributable to the very localized commencement of ignition inherent in a spark system is cycle-to-cycle variation in the performance of a single cylinder, reflected in its p-v diagram.

Ignition cells or cavities associated with combustion chambers in internal combustion engines have been proposed in the past. See, for example, U.S. Pat. No. 2,996,056 to Vierling, U.S. Pat. No. 2,279,709 to Kite and U.S. Pat. No. 3,481,317 to Hughes and DePalma. However, such devices have not come into widespread use because of existing limitations. While it has been possible to provide an ignition cell or cavity which functions well in a given engine at constant speed and load, it has not thus far been possible to make cells which perform well over a wide range of engine and load conditions. Nor has it been possible to generalize the design parameters or criteria of such cells so that in the present state of the art the provision of a cell for a given engine is almost entirely a matter of "cut and try".

Another limitation of existing ignition cells is that they will not start an engine, inamuch as they do not become functional until heated up by heat from the combustion chamber of the engine. The before-mentioned patent to Vierling proposed to overcome this limitation by resistive electrical heating (externally supplied) of the walls of ignition cells. Absent this expedient, in the present state of the art, ignition cells do not permit elimination of the conventional electrical ignition system of an engine, since it is needed at least for starting of the engine and warm-up.

SUMMARY OF THE INVENTION

In accordance with the present invention improved ignition cells for internal combustion engines are provided in which certain critical parameters of the cell are established within defined limits and in which the heat transfer characteristics of the cell are controlled and utilized to optimize its firing properties. In accordance with a further aspect of the invention, improved ignition cells are provided having means for sustaining ignition during starting and warm-up electrically, but without the involved external electrical equipment presently employed.

In the improved ignition cells of the invention, the length-to-diameter ratio of the cell is held within critical limits; the orifice diameter-to-cell diameter is also established within critical limits; the ratio of cell volume to engine displacement is controlled, and for engine displacements in the commonly-encountered range, cell volume is controlled absolutely. In some embodiments ignition timing is controlled by correlation of a dimensional parameter (orifice size), and a heat transfer parameter.

In accordance with one aspect of the invention, the heat transfer parameter utilized for timing control is controlled in part by interposing a sleeve of selected configuration and heat conduction properties between the cell and the ambient. Furthermore, the control sleeve may be made adjustable in position to provide for timing adjustment, both automatically, during engine operation over varying speeds, and/or manually, as during an engine tune-up.

In accordance with another aspect of the invention, the control of ignition timing by means of heat transfer control is effected by configuring the ignition cell, especially its outer surface, to improve heat transfer at a selected point along the length of the cell.

In one embodiment of the invention which includes sparking mechanism for starting purposes, an electrically insulated electrode is provided at the end of the cell remote from its orifice so that a spark may be struck between the electrode and the cell wall upon application of a sufficient votage. No care need be taken to time the spark because continuous or untimed intermittent sparking is sufficient in accordance with the invention, and as a consequence, very simple external voltage supply equipment will suffice for supplying the voltage.

In addition to the integral sparking equipment for the cell just described the invention also contemplates provision of separate sparking mechanism in the form of a small spark plug removably fitted at the end of the cell.

Another embodiment of the invention having supplementary ignition means for use in starting and warm-up incorporates a small resistively heated "glow plug" device inside the cell. Such a glow device requires only a very simple low voltage external electrical power supply system with no timing mechanism, since the geometrical and heat transfer parameters of the cell perform this function in accordance with the invention. In this connection, it should be noted that while glow plugs have been per se known for some time, it has not been practical to apply them to internal combustion engines using the most common fuels, gasoline and natural gas, because of the impossibility of accurately timing ignition. Glow plugs have found practical application only in very small, very high speed engines burning special fuels (model airplane engines) and in low compression diesel cycle engines. In the first of these, timing is not very important; in the second, the timing function is performed by the fuel injection system.

The foregoing aspects and features of the present invention are embodied in a basic cell structure, which cell is cylindrical and equipped with an orifice at one end providing communication with the interior of the engine combustion chamber.

In an engine which is running and warmed up, the walls of the ignition cell are hot, and the cell contains, at the beginning of a given compression stroke (by a piston in a piston engine or by a rotor in a rotary engine), residual hot burned gas from the prior combustion stroke of the cycle. During the first part of a compression stroke, a small portion of the fuel and air mixture in the combustion chamber is forced through the orifice and into the cell. In the cell the fresh charge is at first diluted and heated by the residual hot burned gas, and is heated by the hot walls of the cell. At this early point in the compression stroke, the mixture in the cell is too dilute to burn and is below the critical pressure-temperature combination for self-ignition. As the compression stroke continues, more fuel-air mixture from the combustion chamber flows into the cell, but the rate of entry is limited by the orifice, and as a consequence, throughout the compression stroke the pressure inside the cell lags the pressure in the combustion chamber. The flow into the cell continues with continuation of the compression stroke and the concentration of the combustible mixture and the pressure in the cell both increase as a result. The hot walls of the cell and the hot residual gases therein heat the entering charge. At a point near the end of the compression stroke, the mixture of the cell has become concentrated enough to be combustible, and the temperature, pressure and residence time in the cell reach their critical points for auto-ignition. When these conditions occur, combustion begins in the cell. The almost instantaneous combustion (explosion) causes a rapid rise in the pressure in the cell to a level above that in the engine combustion chamber, and as a consequence flow through the orifice of the cell is reversed and a tongue of flaming mixture is expelled into the main combustion chamber. The expelled flame ignites the compressed fuel-air charge in the combustion chamber and the burning of that mixture results in the delivery of useful power during the expansion stroke of the engine.

The ignition cells of the invention are effectively self-regulating with respect to timing. Increase in engine speed advances the effective timing, while increasing the load at a constant speed tends to retard the timing. Both of these shifts in the timing are in the direction of optimum conditions. No external timing equipment is required. The timing control by the geometry and heat transfer characteristics of the cell result in engine operation at the same or a slightly greater power than that obtained with conventional electrical ignition.

The devices of the invention operate best with lean fuel mixtures, so that better fuel economy can be achieved than with electrical spark ignition. In addition, the leaner mixture requirement means that less carbon monoxide will appear in the exhaust, thus lessening atmospheric pollution and lessening the load on special after-treatment equipment for removing carbon monoxide from the exhaust stream.

Nothwithstanding the leanness of the mixtures employed in engines embodying the invention, the cycle-to-cycle variation in combustion is reduced, as compared to spark ignition with such mixtures, because of the large igniting flame produced by the devices.

The ability of the devices of the invention to operate well on lean mixtures makes them particularly useful in the ignition systems of stratified charge internal combustion engines. Stratified charge engines operate at extremely high compression ratios and with very lean mixtures. With electrical ignition, very high secondary voltages are required, in the neighborhood of 16 to 20 kilovolts. Because the fuel-air mixture is hetereogeneous in the chamber of such an engine, difficulty has been encountered in assuring that a combustible mixture exists at the spark gap at the time of ignition. The ignition cells of the present invention require no electrical sparking during running of the engine, and their good performance on lean mixtures of the kind likely to exist at the ignition point in a stratified charge engine assures reliable commencement of the combustion process.

In addition to operating on leaner mixtures than spark ignition systems, the devices of the invention improve the combustion process in the main combustion chamber of the engine. The improvement in the combustion process is attributable to the flame expelled through the orifice into the chamber to start combustion. The flame is comparatively much larger than an electrical spark. It induces turbulence in the charge, and propogates combustion throughout the charge more rapidly than an electrical spark, both of which effects serve to reduce the burning time of the charge and to carry the burning closer to completion. One result of such improved combustion is that the quantity of unburned hydrocarbon in the exhaust stream is reduced, thereby cutting pollution or the need for after-treatment to avoid it. Another result is somewhat increased power.

The devices of the invention are practically failure-free and require no maintenance. Since they operate at very high wall temperatures and the gas velocities in and near the cells are very high, fouling and the formation of carbonaceous deposits common to spark plugs do not occur. The failure-free characteristics of the ignition cells of the invention make them particularly attractive for use in applications of internal combustion engines where power interruptions caused by ignition failures are dangerous, costly, or both. Such applications include aircraft (for one or both sides of the dual ignition system required by law), pipeline pumping units, electric power generators, irrigation pumps, and marine power plants.

From the foregoing it can be seen that a broad object of the invention is to improve internal combustion engines in their reliability, fuel economy, performance, exhaust emission quality, and absence of radio frequency emissions by providing improved ignition devices of the ignition cell type for use in such engines.

It is a more specific object of the present invention to provide improved ignition cell devices having controlled dimensional and heat transfer parameters rendering the devices capable of satisfactory operation over a wide range of engine speeds and loads.

It is another object of the present invention to provide ignition cell devices having supplementary electrical ignition structures rendering them capable of starting and warming up an engine in an electrical ignition mode, while running the engine under normal conditions in a self-ignition mode.

It is a further object of the invention to provide ignition cell devices in which a heat transfer parameter is exploited as a timing control, and to provide such devices in which said heat transfer parameter is variable and adjustable.

The foregoing objects and purposes, together with other objects and purposes of the invention, can best be understood by a consideration of the detailed description which follows, together with the accompanying drawings.

DESCRIPTION OF THE PREFERRED EMBODIMENTS

Figure 1:
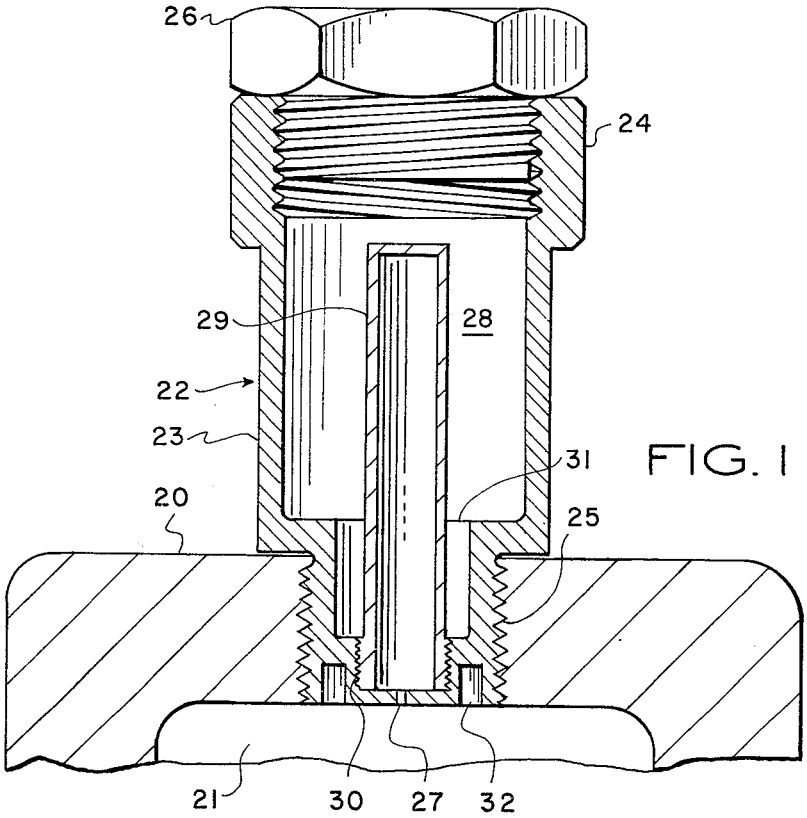
FIG. 1 is a fragmentary elevational view, partly in section, of an ignition device constructed in accordance with the invention, and a portion of an engine in which it is installed.

In FIG. 1 a portion of an internal combustion engine in the vicinity of its combustion chamber is indicated at 20, and part of the combustion chamber itself is designated 21. In an ordinary piston engine, the portion 20 will typically be the cylinder head of the engine. The walls of the combustion chamber 21, including the portion 20, are cooled either by liquid or by contact with the ambient air.

The ignition device of the invention is designated generally as 22. It includes an outer housing 23 which may conveniently be generally cylindrical in shape. At its outer end wrenching surfaces 24 are provided, and its inner end 25 is sized and threaded to fit into a threaded bore in the wall of the combustion chamber of the engine. A closure 26 is threaded into the outer end of the housing 23. At its inner end, housing 23 is closed, except for orifice 27. From the foregoing it can be seen that the outer housing 23 defines a closed inner chamber 28. Mounted in chamber 28 is the ignition cell 29, which is an elongated cylinder open at its lower end so that it communicates with orifice 27, and fitted to outer housing 23 only at its lower end.

From FIG. 1 it can be seen that in the area where cell 29 is attached to the housing, as indicated by the reference character 30, heat dams in the form of inner annular well 31 and outer annular well 32 are provided in the housing 23. In this manner flow paths for heat (by conduction) from the base of cell 29 to housing 23, and ultimately to the cooled wall 20 of combustion chamber 21 are restricted as much as possible, consistent with providing a structure having the required strength to withstand the pressures generated in combustion chamber 21. It should be noted that there is an element of balancing of heat flow considerations in the arrangement of heat dams 31 and 32. Sufficient thermal barriers must be provided to protect the desirably hot base of cell 29 from the cooled wall of the combustion chamber, without raising the temperature of the face of the device in the vicinity of orifice 27 so high that auto-ignition occurs in the combustion chamber 21.

Figure 2:
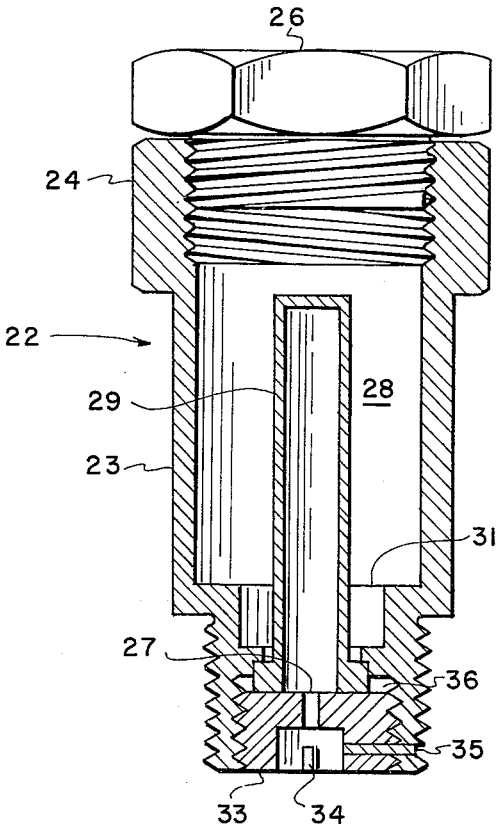
FIG. 2 is an elevational view, partly in section, of another embodiment of an ignition device in accordance with the invention.

FIG. 2 illustrates another embodiment of the invention. Like that of FIG. 1, the device designated generally as 22 includes an outer housing 23 with a closure at its outer end, together with wrenching surfaces 24 near the outer end of the housing. It thus also includes a closed inner space 28 within which is mounted the ignition cell 29. The device of FIG. 2 differs from that of FIG. 1 in that the housing 23 at its inner end is provided with a threaded bore into which is fitted an orifice plate 33 having an orifice 27 therein. Orifice plate 33 is desirably provided with a wrenching slot 34 and a securing pin 35. In this manner provision is made for readily varying the size of orifice 27. From FIG. 2 it can also be seen that heat dams are provided for thermally isolating the base of cell 29 from conductive contact with housing 23 and the cooled wall of the engine combustion chamber. These heat dams include well 31 and annular well 36.

I have found that it is of great importance to satisfactory operation to the ignition cells 29 of FIGS. 1 and 2 to prevent loss of heat from the cell walls to the cooled wall of the engine combustion chamber, and it is for this reason that in accordance with the invention steps are taken as exemplified in FIGS. 1 and 2 to minimize the flow of heat from the cell in the vicinity of the orifice to the cooled wall of the combustion chamber.

In addition to taking special steps to prevent loss of heat from the cell walls to the cooled wall of the engine combustion chamber, and providing a general heat barrier between the cell and the ambient atmosphere in the form of housing 23 and the enclosed inner space 28, I also, in some embodiments of the invention, take special steps to control flow of heat from the cell through housing 23 to the ambient atmosphere, for the purpose of controlling ignition timing. Examples of these special steps are illustrated in FIGS. 3 through 9.

Since orifice size is the primary determinant of timing (through control of the rate of entry of gas from the combustion chamber into the cell, thereby establishing the time in the cycle at which critical pressure is reached), flow-of-heat timing control is achieved in conjunction with orifice size timing control. Because total reliance is not placed on orifice size for timing control, it is thus possible to accomodate the orifice size to other factors that it has an influence upon (such as the size of the injected flame) even though such accomodation may move the orifice size away from the optimum for timing, and to compensate for such deviation by flow-of-heat control of timing.

By providing at selected points along the length of the cell highly effective flow paths for heat from the cell 29 to the housing 23 and thence to the ambient air, I can establish an effective "thermal length" for the cell different from its geometrical length. "Thermal length" is that length of the cell from its orifice toward its outer end in which hot gases near or above the critical temperature for ignition are resident throughout the engine cycle. All other things being equal, a short termal length advances timing and a long thermal length retards it.

Figure 3:
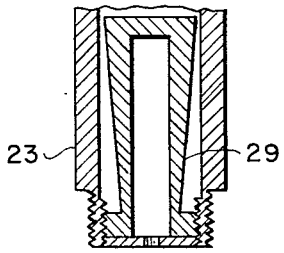
FIG. 3 is a fragmentary sectional elevational view of an ignition device in accordance with a further embodiment of the invention having means for controlling heat transfer between the cell cylinder and the remainder of the ignition device.
Figure 4:
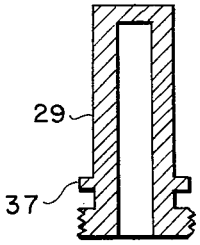
FIGS. 4 through 9 are somewhat diagrammatic sectional elevational views of ignition cell cylinders constructed in accordance with the invention, and having means for controlling heat transfer between the cylinders and the remainder of the ignition device.
Figure 5:
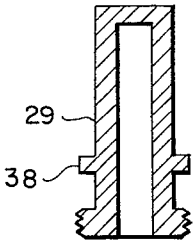
Figure 6:
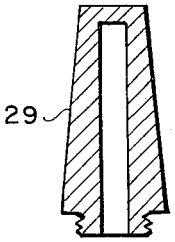
Figure 7:
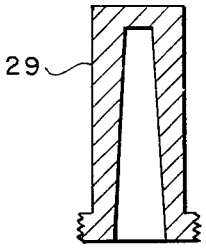
Figure 8:
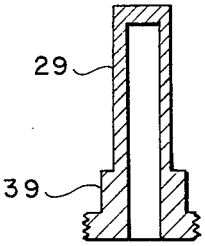
Figure 9:
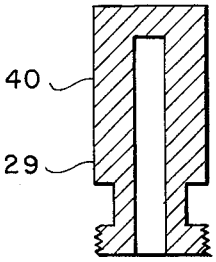

The manner in which thermal length is changed from geometrical length of the cell is illustrated in FIGS. 3 through 9. Basically, the technique used is to selectively vary the space between the outer wall of the cell and the inner wall of the housing. This means is quite effective, because radiant heat transfer is a significant component of the total heat transfer at the temperatures involved, and the rate of radiant heat transfer is dependent upon the fourth power of the reciprocal of the distance between the radiating body and the receiving body. FIG. 3 is a cell designed to have a long thermal length, and the diameter of its outer wall is progressively increased toward the outer end of the cell. In FIG. 4 a rib 37 surrounds the cell to provide a heat coupling point to the housing wall, at a point toward the lower end of the cell to provide a short thermal length. FIG. 5, by contrast, illustrates a cell having an annular rib 38 at a point further toward its outer end to provide a longer thermal length. The cell of FIG. 6 is one designed to have a short thermal length; this is achieved by having the outer diameter of the cell largest near its lower end and tapered to a smallest diameter at its outer end. The variation illustrated in FIG. 7 is one in which the outer diamter of the cell is held constant, but the inner diamter is reduced toward the outer end of the cell. This places more material for heat conduction near the outer end of the cell and hence increases its effective thermal length. In FIG. 8 the cell is designed to have a short thermal length by having a region of increased outside diameter 39 near the lower end, while in FIG. 9, the cell is designed for a long thermal length and therefore has a region of increased outside diameter 40 near its outer end.

Figure 12:
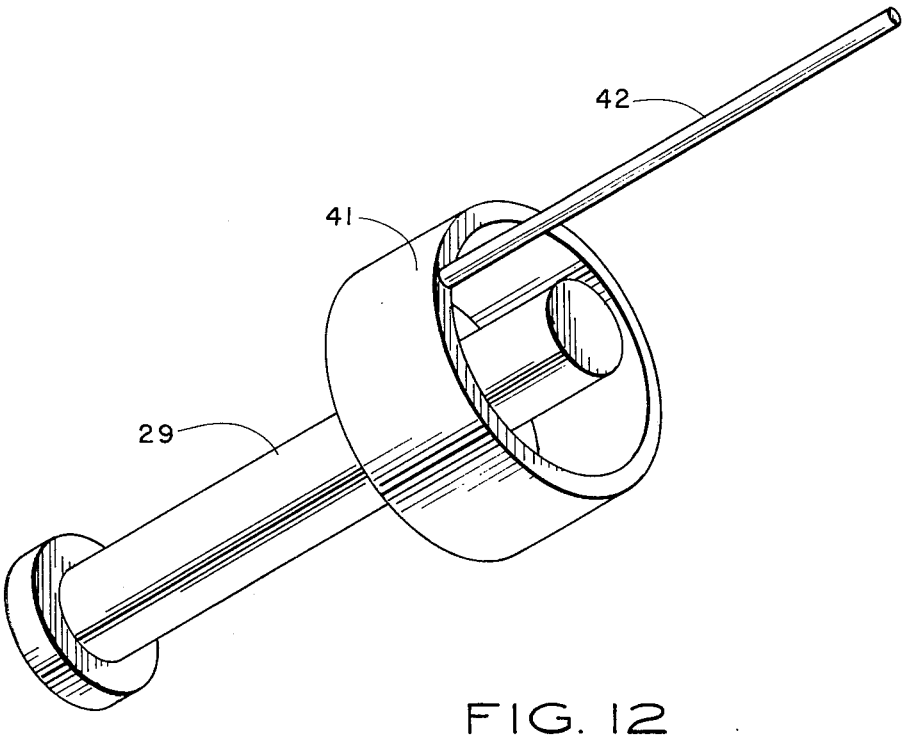
FIG. 12 is a partial isometric view of still another embodiment of the invention in which means are provided for varying the heat transfer properties of the cell.

Attention is now directed to FIG. 12 which illustrates somewhat diagrammatically an embodiment of the invention in which flow of heat control of timing is adjustably achieved. From FIG. 12, it can be seen that cell 29 is surrounded in part by an annular sleeve 41 which is mounted on control rod 42. A comparison of FIGS. 1 and 12 will make it clear that sleeve 41 thus occupies a portion of inner space 28 of the device. By moving control rod 42, sleeve 41 can be positioned at different locations along the length of cell 29. When sleeve 41 is constructed of a conducting material, such as metal, it improves the flow path for heat out of the cell in its vicinity. When sleeve 41 is constructed from an insulating material, such as asbestos, it obstructs the heat flow path out of the cell in its vicinity. Control rod 42 is desirably passed through end closure 26 (see FIG. 1) of the outer housing, and means for adjusting the position of the control rod 42 and sleeve 41 are mounted externally of the housing 23. These means may be of the kind which can be adjusted and set during tuning of the engine, for example, lock and set screws, or they may be means responsive to engine speed and/or load for timing variation in accordance with variations in engine operating conditions.

In connection with FIG. 12 it should also be noted that sleeve 41 may be permanently fixed at an axial position with respect to cell 29, and sleeve 41 may be made in part of an insulating material and in part of a good conductor such as metal.

Figure 10:
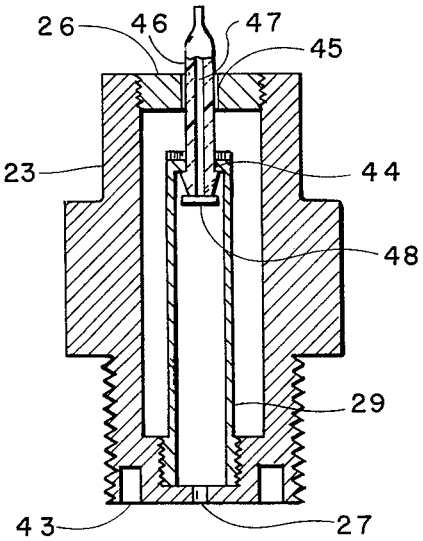
FIG. 10 is a sectional elevational view of another embodiment of the invention which includes means for providing an ignition spark during starting and warm-up of an engine.
Figure 11:
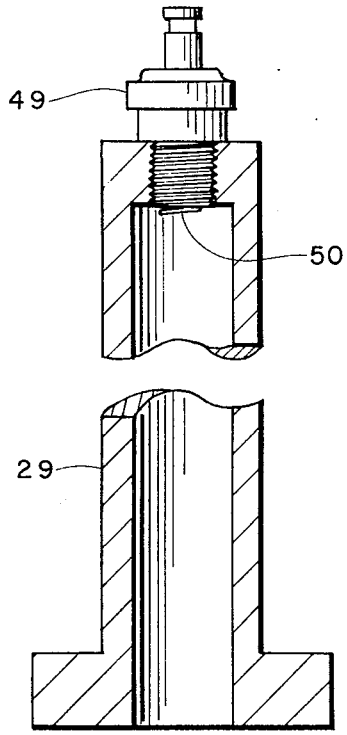
FIG. 11 is a sectional elevational view of the cell of another ignition device constructed in accordance with the invention and provided with glow or hot point ignition means for use in starting and warm-up an engine.

FIGS. 10 and 11 illustrate embodiments of the invention which are provided with supplementary ignition means for use in starting and warm-up as discussed above. In FIG. 10 there is shown a complete device, including an outer housing 23, having an orifice 27 and an end closure 26, and a cell 29. An annular heat dam 43 is provided at the bottom of the housing in the vicinity of the mounting of the cell in the housing. In FIG. 10, a bore 44 is provided in the upper end of cell 29, and an aligned bore 45 is provided in the closure 26 of the outer housing. An insulating sleeve, for example, a ceramic sleeve 46 passes through these bores from a point within the cell 29 to a point externally of the closure 26. Sleeve 46 is bonded in gas-tight manner to cell 29, but passes through closure 26 with sufficient clearance to accomodate for expansion and contraction upon heating and cooling. A conductive lead 47 passes through insulating sleeve 46 and terminates inside cell 29. To its end is attached a disc-like electrode 48. When a voltage is applied to electrode 48 which is sufficiently higher than the ground of cell 29 (which is grounded through the engine structure) a spark is struck within cell 29 between the electrode and the inner cell wall. The spark will ignite a combustible mixture when such is in its vicinity, as will occur once during each cycle. Since, as explained above, the cell geometry and heat transfer properties control the timing, the spark struck within the cell in the manner just described need not be timed. Therefore, only voltage supply equipment need be provided externally of the engine, and no timing apparatus for the voltage supply equipment is needed. The spark may be continuous or intermittent but at a higher frequency than the rotational speed of the engine. Temperature sensing means may be employed to activate and deactivate the sparking system so that it is activated only when it is needed, that is, when the cell wall is cold.

In FIG. 11 there is shown somewhat diagrammatically a cell 29 into the end of which is threaded a glow plug device 49. Glow plug device 49 includes a glow element 50 formed, for example, of nichrome-wire. A comparison of FIGS. 1 and 11 will reveal that the electrical lead for the glow plug device 49 passes through closure 26 to a point external of the device.

Upon the application of a low voltage to the leads of the glow plug device, the glow element or hot point 50 reaches an incandescent temperature sufficient to ignite a combustible mixture in its immediate vicinity. Since, as explained above, such a mixture is present once during each cycle of the engine, the glow device will cause ignition nothwithstanding the fact that the walls of the cell 29 may be too cold to cause ignition in the manner they do when the engine is fully warmed up. As was the case with the embodiment of FIG. 10, no external timing means are required for operation of the glow device, and temperature sensitive means may be employed to activate and deactivate it in response to the temperature of the cell wall. In both of the embodiments of FIGS. 10 and 11, the temperature sensitive activating and deactivating means may sense any engine temperature which closely and reliably follows cell wall temperature. One such temperature which may be conveniently sensed is the temperature of the device gasket.

In connection with FIG. 11, it should also be noted that glow device 49 may be replaced with a conventionally configured spark plug having an electrode for striking a spark to the grounded wall of the plug. In operation, this alternate embodiment functions in the same manner as the embodiment of FIG. 10.

The embodiments of the invention illustrated and discussed thus far are ones in which the devices are mounted on the engine by being screwed into threaded bores. Alternate installation systems, such as clamps of the kind sometimes employed with spark plugs, may also be employed in accordance with the invention.

The dimensional and thermal aspects of the present invention are illustrated by the data presented in the tables below. Two types of ignition devices were employed in these tests. Those designated type A were substantially like the device illustrated in FIG. 1 of the drawings with the exception that heat dam 32 was omitted and a sleeve, such as 41, of FIG. 12, was employed running substantially the full length of cell 29. The other type designated in the tables type B, was substantially like the device illustrated in FIG. 2 of the drawings.

The data reported below were obtained from runs made on a Continental C85 aircraft engine. This engine is a four cylinder, four stroke, horizontal-opposed, air cooled, overhead valve, dual ignition engine. It has a bore of 4 1/16 inch and a stroke of 3⅝ inches. Its displacement is 188 cubic inches (47 cubic inches per cylinder) and the compression ratio is 6.321. The rated power of this engine is 86 bhp at 2575 rpm (BMEP: 138 psi). The engine was normally spark fired and the normal ignition timing for the right magneto (top plugs) was 28° BTC and for the left magneto (bottom plugs) 30° BTC.

The load of the engine during the test was applied by means of a 72 inch diameter, 47 inch pitch McCauley metal two bladed aircraft propeller. The observed maximum static speed for this engine on its aircraft was 2,250 rpm.

The test procedure followed was to install the devices of the invention in the lower or bottom spark plug holes, replacing the 30° BTC spark plugs. The engine was started with the remaining spark plugs used for initial ignition and run for three to five minutes at speeds of 1800 to 2000 rpm until the ignition device gasket temperature, as measured by a thermocouple, reached 300°F. The magneto operating the spark plugs was then grounded and the engine was run solely on ignition from the devices of the invention.

Three criteria were used to evaluate performance of the devices in these tests. The first was engine speed range. The broader the range of speed over which the devices will operate the better the performance is regarded. The second criteria is termed in the following tables "magneto drop-off". As is known, in a dual ignition engine of the aircraft type, grounding of one of the two magnetos will result in a drop of a significant number of rpm in engine speed. For this particular engine, the normal drop was 75 to 100 rpm at an engine speed of 2000 rpm. Therefore, when a magneto drop-off of less than 75 rpm is reported in the following tables, this means that the devices of the invention were performing better than the spark plugs they replaced. Conversely, reported magneto drop-offs of greater than 100 rpm in the following tables indicate that the devices were performing less effectively than the spark plugs they replaced.

The third criterion is relative roughness or smoothness of engine operation, and it was measured by carefully qualitatively sensing the vibrations of the engine and assigning a relative descriptive word such as "rough" or "smooth" to the sensed performance.

As appears from the tables, length-to-diameter ratios for the cells 29 were varied; the diameter of orifice 27 was varied, the cell volume was varied, and insulation of the cells was varied, in the course of the tests.

The numerical values of each of the inventions are reported in the tables.

TABLE I

EFFECT OF VARIATION OF LENGTH TO DIAMETER RATIO (L/D) OF THE CELL ON THE PERFORMANCE OF THE IGNITION DEVICES

Design: Type A
Orifice Diameter: 0.059"

| Run No. | L/D | Speed Range, rpm | Magneto Drop-off, rpm | Quality |
|---|---|---|---|---|
| 1 | 5.48 | 1000–2100 | 200 | Smooth |
| 2 | 7.00 | 1500–2100 | 50 | Smooth |

TABLE I-continued

EFFECT OF VARIATION OF LENGTH TO DIAMETER RATIO (L/D) OF THE CELL ON THE PERFORMANCE OF THE IGNITION DEVICES

Design: Type A
Orifice Diameter: 0.059"

| Run No. | L/D | Speed Range, rpm | Magneto Drop-off, rpm | Quality |
|---|---|---|---|---|
| 3 | 8.00 | 1200–2000 | 200 | Smooth |

From Table I it can be seen that devices of the invention will operate over an L/D range of about 5 to about 8 and that the best L/D ratio is about 7.0.

TABLE II

EFFECT OF ORIFICE DIAMETER ON THE PERFORMANCE OF THE IGNITION DEVICES

| Run No. | Orifice Dia., Ins. | Cell Dia., Ins. | Orifice Dia./ Cell Dia. | Speed Range, rpm | Magneto Drop-off, rpm | Quality |
|---|---|---|---|---|---|---|
| Design: | Type B | | | | | |
| L/D: | 7.00 | | | | | |
| 4 | 0.0465 | 0.200 | 0.233 | 900–1900 | — | Smooth |
| 5 | 0.0500 | 0.200 | 0.250 | 900–1900 | 0 | Smooth |
| 6 | 0.0520 | 0.200 | 0.260 | 900–1900 | 75 | Rough |
| 7 | 0.0550 | 0.200 | 0.275 | 900–2250 | 0 | Rough |
| Design: | Type A | | | | | |
| L/D: | 5.48 | | | | | |
| 8 | 0.059 | 0.228 | 0.259 | 1000–2100 | 200 | Smooth |
| 9 | 0.067 | 0.228 | 0.250 | 1000–2100 | 200 | Smooth |
| Design: | Type A | | | | | |
| L/D: | 8.00 | | | | | |
| 10 | 0.059 | 0.192 | 0.307 | 1200–2000 | 200 | Smooth |
| 11 | 0.067 | 0.192 | 0.349 | 1000–2000 | 200 | Smooth |

Table II also confirms the L/D range and optimum point discussed above in connection with Table I. Furthermore, it shows that the orifice diameter-to-cell diameter should be about 1 to 4. More particularly, the range of such ratios is from about 0.23 and about 0.35.

TABLE III

EFFECT OF CELL VOLUME ON THE PERFORMANCE OF THE IGNITION DEVICES

Design: Type A
Orifice Diameter: 0.067"

| Run No. | Cell Vol., cu., ins. | Speed Range, rpm | Magneto Drop-off, rpm | Quality | L/D |
|---|---|---|---|---|---|
| 12 | 0.0445 | 1600–2000 | 100 | Rough | 5.88 |
| 13 | 0.0510 | 1000–2100 | 0 | Smooth | 5.48 |
| Design: Type A | | | | | |
| Orifice Diameter: 0.063" | | | | | |
| 14 | 0.0344 | 1600–2100 | 300 | Smooth | 6.68 |
| 15 | 0.0550 | 1200–2100 | 100 | Rough | 5.28 |
| 16 | 0.0613 | 1500–2100 | 300 | Rough | 5.00 |

The data in Table III indicate that the ratio of the cell volume to the displacement volume of the engine cylinder (47 cubic inches) should fall within the range of about 0.00096 to about 0.00117.

TABLE IV

EFFECT OF ASBESTOS PAPER INSULATING SLEEVE AROUND CELL ON PERFORMANCE

Design: As shown in FIG. 1

| Run No. | Insulation | Orifice Dia., Ins. | L/D | Speed Range, rpm | Magneto Drop-off | Quality |
|---|---|---|---|---|---|---|
| 17 | absent | 0.055 | 7.0 | 1200–2000 | 50 | Smooth |
| 18 | present | 0.055 | 7.0 | 800–2000 | 50 | Smooth |
| Design: | Type B | | | | | |
| 19 | present | 0.055 | 7.0 | 900–2250 | 0 | Rough |
| 20 | absent | 0.055 | 7.0 | 1200–2250 | 0 | Rough |

The data in Table IV show that use of an insulating material around the cell broadens the range of speed over which the engine operates well.

While for the sake of clarity, the various features of the present invention have been shown in the drawings and discussed in this description in somewhat separate and segregated fashion, it should be understood that the several features of the invention may be incorporated together into a given device having optimum performance characteristics.

What is claimed is:

1. An ignition device for use in an internal combustion engine of the kind having a combustion chamber in which successive charges of a fuel-air mixture are introduced and are compressed, ignited, expanded, and exhausted, and including means for cooling a wall of the combustion chamber, said device comprising:

an elongated ignition cell having a base adapted to be mounted in the cooled wall of the combustion chamber, said cell having a length to diameter ratio above 5:1, and having an orifice formed in said base for providing communication between the interior of said cell and the interior of the combustion chamber, said orifice diameter being at least 0.23 the diameter of said cell;

mounting means for securing said cell in the cooled wall of the combustion chamber, including means blocking flow of heat between said base of said cell and the cooled wall of the combustion chamber, said blocking means including a circular groove in said base surrounding said orifice and spaced therefrom;

and means surrounding said cell for controlling flow of heat between said cell and the ambient.

2. An ignition device in accordance with claim 1 in which the cell length to diameter ratio is about 7:1.

3. An ignition device in accordance with claim 1 in which the cell orifice diameter is about one-fourth the diameter of the cell.

4. An ignition device in accordance with claim 1 in which the ratio of the volume of said cell to the displacement volume of the engine cylinder is between about 0.00096 and about 0.00117.

5. An ignition device in accordance with claim 1 in which the volume of said cell is between about 0.045 and about 0.055 cubic inches.

6. An ignition device in accordance with claim 1 and further comprising means for timing ignition in said combustion chamber by withdrawing heat from said cell at a selected point spaced from said orifice.

7. Apparatus in accordance with claim 6 in which said timing means comprises a protuberance on the external wall of said cell enhancing heat transfer therethrough to said housing means.

8. Apparatus in accordance with claim 6 in which said timing means comprises a sleeve surrounding at least a portion of said cell.

9. Apparatus in accordance with claim 8 and further comprising means for selectively positioning said sleeve lengthwise of said cell.

* * * * *